United States Patent [19]

Bergeron

[11] Patent Number: 4,817,974

[45] Date of Patent: Apr. 4, 1989

[54] SKATES AND SKATE BOARDS

[76] Inventor: Robert L. Bergeron, 1312 Pineywoods, Friendswood, Tex. 77546

[21] Appl. No.: 126,711

[22] Filed: Nov. 30, 1987

[51] Int. Cl.[4] ..... A63C 17/14

[52] U.S. Cl. ..... 280/11.2; 280/11.19; 280/87.042

[58] Field of Search ..... 280/11.19, 11.2, 11.27, 280/11.28, 87.04 A

[56] References Cited

U.S. PATENT DOCUMENTS

| | | | |
|---|---|---|---|
| 863,675 | 8/1907 | Towle | 280/11.19 |
| 1,211,557 | 1/1917 | Dore | 280/11.19 |
| 1,632,997 | 6/1927 | Connolly | 280/11.19 |
| 4,095,817 | 6/1978 | Cohen | 280/87.04 A |
| 4,240,132 | 12/1980 | Wickman | 280/11.2 |
| 4,298,209 | 11/1981 | Peters | 280/11.2 |

OTHER PUBLICATIONS

"5th Wheelie," Surface Magazine, Oct./Nov. 1976 p. 118.

"Roller Wheelie," Skate-Boardor Magazine, vol. 2 #6 Aug. 1976, p. 38.

*Primary Examiner*—David M. Mitchell

[57] ABSTRACT

A roller skate or skate board construction where a base member has a pair of rearward wheels. An auxiliary wheel member is located above the ground and rearwardly of the rear wheels to provide a "third wheel" support upon tilting of the base member. The "third wheel" is spring mounted to provide for compression when force is applied to the wheel. A stop member prevents overtilting of the base member.

16 Claims, 4 Drawing Sheets

SKATES AND SKATE BOARDS

FIELD OF THE INVENTION

This invention relates to roller skates and skate boards, and more particularly to three wheel roller skates or skate boards for entertainment purposes which permit safe operation with a tilted base as well as a base parallel to a ground surface.

BACKGROUND OF THE INVENTION

Heretofore, roller skates and skate boards have typically been constructed with forward and rearward parallel axles, each axle supporting a pair of spaced apart wheels. The axles, in turn, are supported relative to a shoe or base plate member. Skaters require all of the wheels for balance and the average skater does well to maintain balance on the four wheels without falling. Only expert skaters can perform entertainment maneuvers. Novelty skate and skate board constructions have been made where two or more wheels are aligned in a lengthwise longitudinal plane similar to an ice skater's blade. These skates are difficult to master in use and are not popular.

The Present Invention

The present invention is embodied in a construction where a base plate can be tilted relative to a pair of spaced apart wheels on a rear axle to engage an auxiliary rear wheel for a three point contact, thereby obtaining a different skating condition known as a "wheelie".

In a three wheel skate construction, a single forward wheel is positioned along a longitudinal plane which bisects the space between the two rear wheels. Rearwardly of the rear wheels is a single rearward auxiliary wheel disposed along the longitudinal plane. The forward and rearward single wheels are smaller in diameter than the rear wheels, the rearward auxiliary wheel being the smallest in diameter. The forward wheel and two rear wheels are arranged and supported on a base member for a shoe or skate board so as to normally engage a ground or contact plane for a normal skating position or condition. The axle for the single auxiliary rear wheel is mounted on a lever arm structure which is pivotally connected at a mid-length of the base member and is normally located to position the auxiliary rear wheel above the ground level. The lever arm structure in its normal position has a spring member disposed between the lever arm structure and the base member which can be adjusted with respect to compression force. Thus differences of the individual body weights can be compensated by adjustment of the compression of the spring member. A back stop member is mounted relative to the base member so as to be located between the rear wheels and the rearward auxiliary wheel and is normally located above the ground structure. The skater can tilt the base member upwardly about the axis of the rear wheels and bring the rear stop wheel into engagement with the contact plane so that the skate is supported by three wheels in a tilted position which can be designated a "wheelie" position. The back stop member limits the degree of tilt by engaging the contact surface thus preventing an over tilt or loss of balance. At the forward end of the base member is a toe stop member for protecting the front wheel and for stopping purposes.

For effect, functional headlights are attached to the base member, tail lights are attached to the wheel of the shoe, and fenders are affixed to a Y shaped metal bracket member.

DESCRIPTION OF THE PRESENT INVENTION

Figure 2:
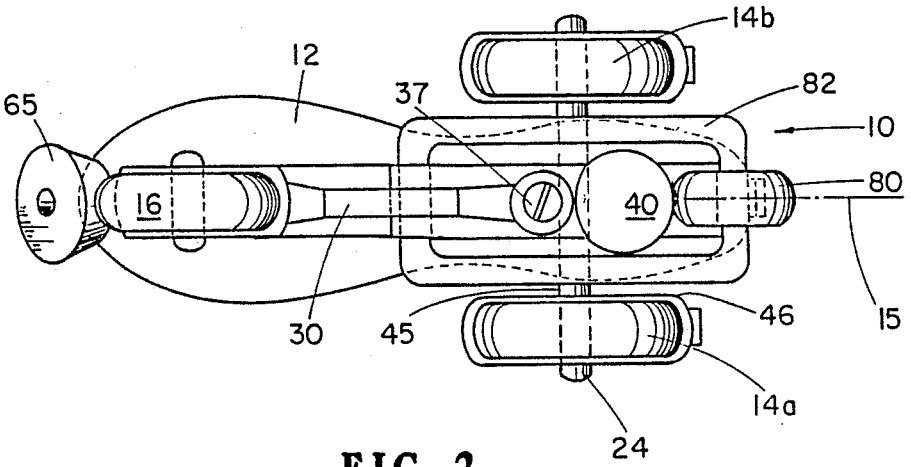
FIG. 2 illustrates a bottom view of the skate shown in FIG. 1.

Referring now to the drawings, a three wheel skate 10 is illustrated wherein a shoe member 11 is attached to an elongated base plate member 12. The base plate member 12 supports a pair of spaced apart rear wheels which are disposed at equal distances to either side of a vertical lengthwise extending plane 15 (see FIG. 2). The base plate member 12 also supports a single forward wheel 16 which is disposed on or along the vertical lengthwise extending plane 15. The forward wheel 16 may be 3 inches in diameter while the rear wheels are 3½" in diameter. The difference in diameter makes it easier to displace the front wheel 16 off of a contact plane 18 by tilting the base member about the axis of the rear wheels **14*a*, 14*b*. In common usage the tilt back feature is called a "wheelie". The construction of the wheels 14*a*, 14*b* and 16 are constructed from extra soft neoprene rubber or urethane "soft" material. Urethane is lighter than neoprene and is preferable. All wheels have ball bearings for easy rotation. The three wheels 14*a*, 14*b* and 16** form a three wheel skate which supports a skater for a normal skating function.

Figure 1:
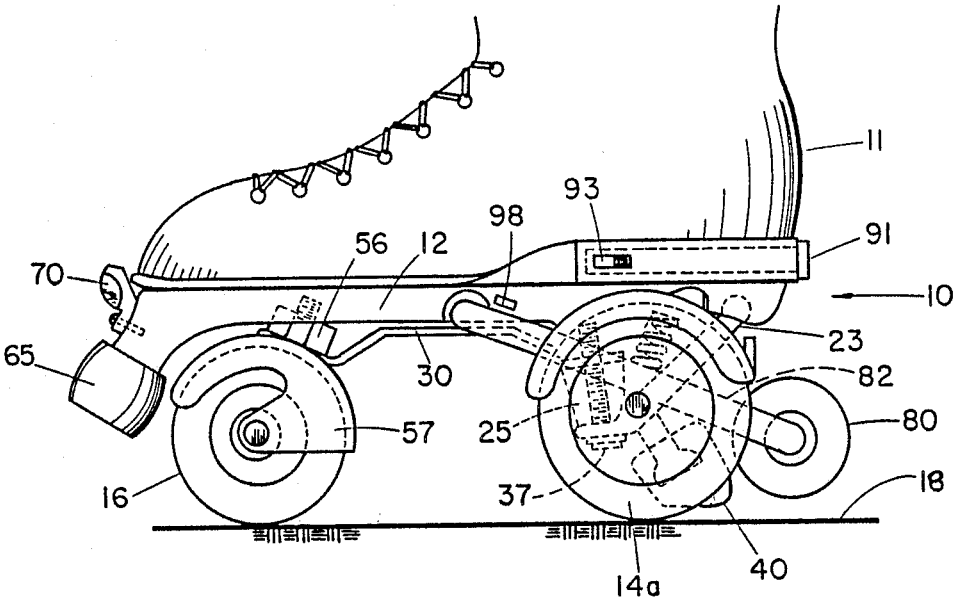
FIG. 1 illustrates in side view a three wheel skate according to the present invention.
Figure 3:
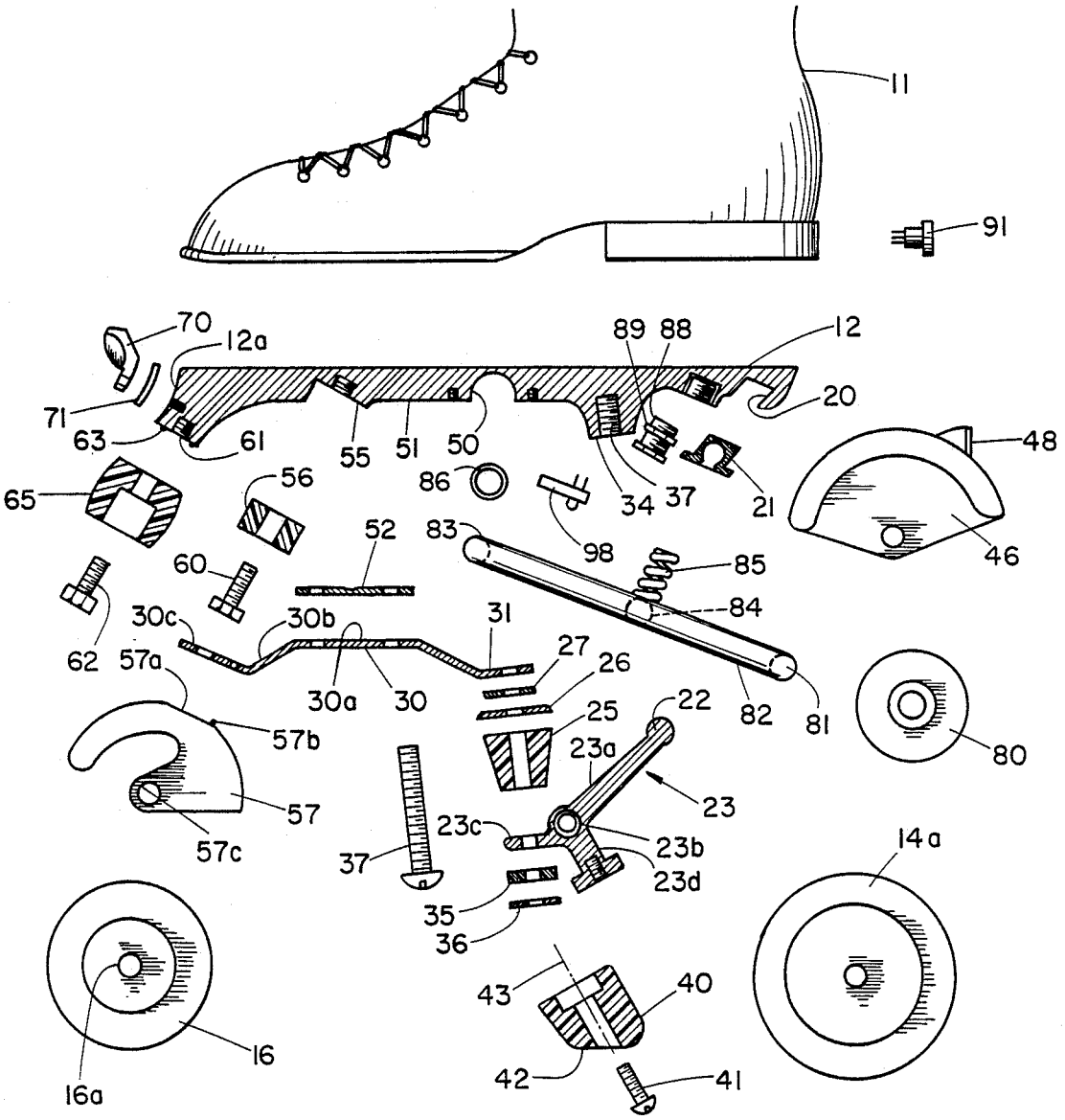
FIG. 3 is an exploded view illustrating the various components of the skate in side view.

The base member 12 has a rearwardly located hollow or blind socket 20 and ball socket fitting 21 (see FIG. 3) which are at an angle relative to a vertical and receives a ball end 22 of a Y shaped metal bracket member 23. The bracket member 23 is preferably constructed of cast aluminum and consists of a rearward elongated arm portion **23*a* which joins an axle or hub portion 23*b* which is sized to receive and support a tubular axle support 24 for the axle of the rear wheels 14*a*, 14*b*. In the position shown in FIG. 3 and FIG. 1, a nearly horizontal but slightly downward extending lug portion 23*c* provides a base for an annular cushion or shock absorber member 25 constructed of hard rubber or flexible plastic material. An annular metal cap member 26 and a metal washer 27 are disposed between the cushion member 25 and an angularly configured metal bracket member 30. The bracket member 30 has a flat portion 31 arranged to contact a flat surface 34 on the bottom of the base member 12 at a location along the vertical plane and at a rear one-third location on the base member 12. An annular cushion or shock absorber member 35 constructed of hard rubber and a metal washer 36 are located below the lug portion 23*c*. A bolt 37 extends through the bores in the washer 36, the members 35, 23*c*, 26–27 and is received in a threaded bore 37 in the base plate member. Thus, with the ball member 22 in the ball socket 20, the bolt 37 attaches the Y shaped bracket member 23 to the base member 12**. The hard rubber members 25, 35 have resiliency which permit limited pivotal movement and shock absorption of the bracket member 23 relative to the base member. At approximately 90° from the lug portion 23c on the bracket member 23 is a base portion 23d. An annularly configured back stop member 40 is arranged to have one end interfit with the base portion 23d and is attached to the base portion 23d by a metal bolt 41. The back stop member 40 has a downwardly facing surface 42 disposed at an oblique angle relative to the axis 43 of the back stop member where the downwardly facing surface 42, in a normal position, is parallel to a contact or ground surface and is located about one-half of an inch above a contact surface. The back stop member 40 can be constructed from hard rubber material.

The hub portion 23b of the bracket member 23 has a transverse bore which receives a tube member which extends outwardly from the bracket member 23 and the vertical plane 15 to a location 45 (see FIG. 2) proximate to a fender member 46. A fender member 46 is a shaped piece of metal with a vertical wall and an arcuate curved enclosure wall. A fender member 46 is suitably attached to the axle tube member at 45 and provides a decorative ornamentation for the rear wheels. In addition, light reflectors 48 can be disposed on the fender for nighttime light reflection.

Midway of the length of the base member 12 is a transverse partial bore 50 which has a transverse opening into the bottom surface 51 of the base member 12. A rectangularly shaped metal pad member 52 fits between a flat portion 30a on the bracket member 30 and the base member 12. The base member 12 and the plate member 52 are attached by machine screws (not shown) to the base member 12. The bracket member 30 has an angled end portion 30b which has a surface 30c arranged parallel to and spaced from an inclined surface 55 in the bottom surface of the base plate member 12. Between the surfaces 30c and 55 is an annular spaced member 56 constructed of hard rubber. A forward fender member 57 has a generally curved and semi-enclosed configuration with an upper flat surface 57a and a projecting locking pin 57b. A machine bolt 60 extends through an opening in the fender, the spacer member 56 and threadedly attaches the fender member 57 to the base member 12. The pin 57b is received in a locking opening in the bracket member 30 so that the member 57 cannot rotate relative to the bracket member 30. At a central location in the fender member 57 are axle openings 57c for receiving a axle 16a of the front wheel 16. The spacer member 56 provides for shock absorption.

The forward end of the base member 12 has a forwardly, downwardly angled surface projection 12a with a forward circular face 61. An annular, front toe stop member 65 constructed of hard rubber material is fastened to the base plate member 12 by a machine bolt 62. Ridges 63 on the circular face 61 can be used to eliminate any problem of the toe stop member turning about the bolt 62. The toe stop member 65 is intended to enable the skater to stop by elevating the rear wheels so that the toe stop member engages a contact surface.

On the front surface of the base plate member is a decorative and functional headlight member 70 which is mounted with rubber backing 71 for shock absorption on the base plate member 12.

A rearward wheel 80 of about two inches in diameter and constructed from soft neoprene rubber or urethane has a roller bearing journal which receives a transverse axle component 81 of a tilting bar or lever member 82. The tilting bar or lever member 82 is shaped as a rectangular FIG. 8 where the opposite transverse end portion 83 is rotatively mounted in a nylon bearing sleeve 86 and secured to the base plate member 12 by the bracket member 30 and the spacer member 52. On the intermediate transverse bar portion 84, a coiled spring member 85 is mounted on a perpendicular pin member where the opposite end of the spring member 85 is received in a blind bore of a threaded member 88. The threaded member 88 is threadedly received in a bore in the base plate member 12 and a lock nut 89 is provided. By adjusting the position of the member 88, the compression and tilting action of the rear wheel 80 can be controlled for individual body weights.

Figure 4:
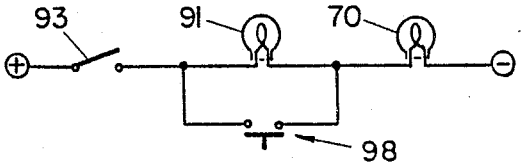
FIG. 4 is an electrical schematic.

A rear light means 91 is shown and is attachable in the heel of a shoe. The light means 91 can be battery powered by batteries located within the heel and controlled by an on-off control switch 93. As shown in FIG. 4, an on-off switch 93 controls power to the lights 70 and 91. A limit switch 98 can be attached to the base plate member 12 and actuated by tilting of the tilt bar 82 so that a light is actuated when a "wheelie" is performed.

In operation, a skater has three main wheel supports with the spacer members 56 and 25 providing for flexture and shock absorption of the base member 12 (and shoe) relative to the three main wheels on a ground surface. To perform a "wheelie" (tilt back of the base member relative to the rear wheels), the skater lifts the toe part of the shoe. The spring member 85 is adjusted or pre-set to a person's body weight so that the body weight can overpower the spring member 85 yet provide a reaction force that enables a tilted ride on the two rear main wheels and the rear tilt wheel to be maintained. If the skater tilts too far backward, the rubber rear toe stop 40 engages the contact surface and prevents uncontrolled rearward tilting.

Figure 5:
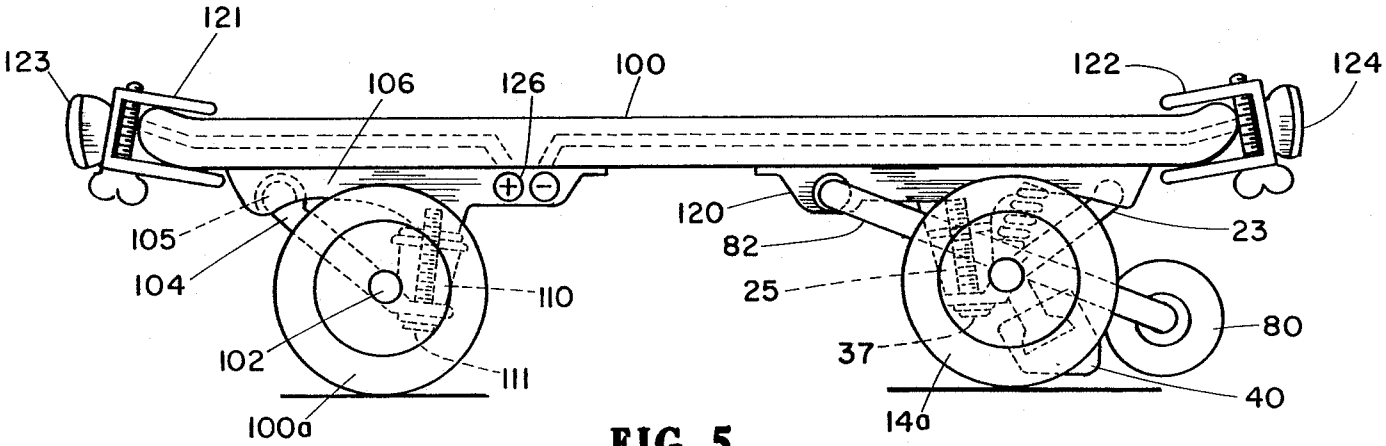
FIG. 5 is a side view of a skate board embodying the present invention.
Figure 6:
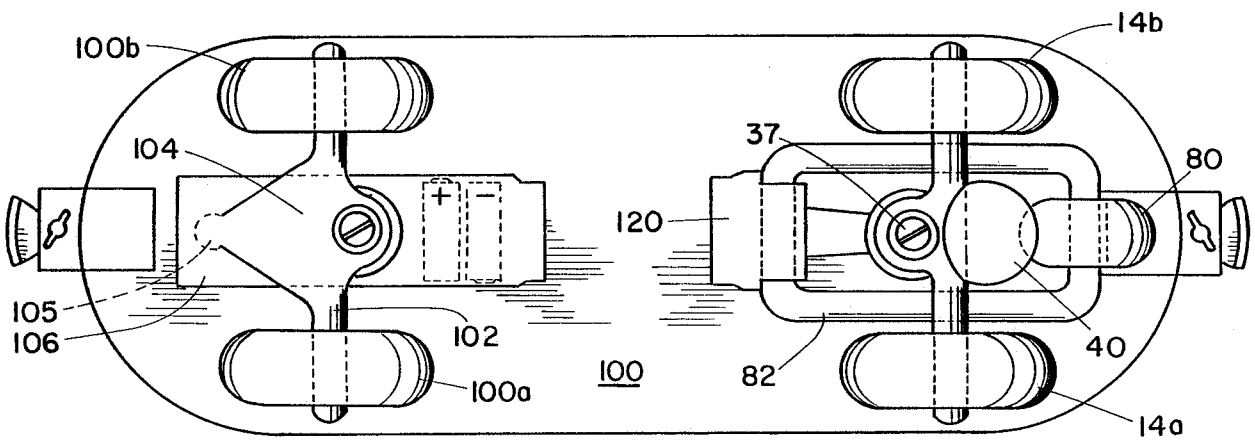
FIG. 6 is a bottom view of the skate board shown in FIG. 5.

In FIGS. 5 and 6, the present invention is shown as applied to a skate board. A skate board or base member 100 has a rectangular and elongated configuration. A forward pair of wheels 100a, 100b are rotatively mounted on an axle 102 which is journalled in a support plate 104. The support plate tapers upwardly from the axle journal toward one end where it has a ball member 105 which is pivotally received in a ball socket in an attachment plate 106. The other end of the plate 104 engages an annular hard rubber shock absorber member 110 and a bolt 111 passes through the plate 104, the absorber member 110 and threadedly attaches to the plate 106. The plate 106 is suitably attached to the bottom of the skate board. A pair of rearward wheels 14a, 14b and an auxiliary wheel 80 are structurally arranged and supported on an attachment plate 120 in exactly the same fashion and manner as described with respect to FIGS. 1–3.

Forward and rearward light brackets 121, 122 can be releasably attached to the base member 100 by suitable clamping means such as bolts. Miniature lights 123, 124 are on the clamping means and electrically connected to a battery means and switch 126.

The operation of the skate board is the same as described with respect to skates. By tilting the base member about the rear wheels the auxiliary wheel 80 provides a third wheel support for a "wheelie" and the stop member 40 prevents an over tilt condition.

With respect to the present invention it will be appreciated that the concepts and styling can be modified without losing the basic principals involved. For example, a Y shaped bar can be substituted for a fender member 57; the toe shoe 40 can be mounted on the bar member 82, and so forth.

The foregoing disclosure and description of the invention are illustrative and explanatory thereof, and various changes in the size, shape and materials, as well as in the details of the illustrated construction may be made without departing from the spirit of the invention.

I claim:

1. A skate construction of the type where a skating base member is supported by rotating wheels members on a skating ground surface for permitting tilting of the skating base member relative to the skating ground surface comprising:

an elongated skating base member;

forward and rearward wheel means rotatively supported on said base member, said wheel means being located at the front and the back of said base member for contacting a skating ground surface, said rearward wheel means including at least two spaced apart rear wheel members on a rear wheel axle, said rear wheel members being respectively located on opposite sides of a vertical lengthwise extending plane extending through said skating base member;

auxiliary wheel means disposed rearwardly of said rear wheel members and consisting of one wheel member located along said lengthwise extending plane and where said one wheel member is smaller in diameter than the diameter of the rear wheel members;

support means attached to said base member for supporting said auxiliary wheel means at a location normally out of contact with a skating ground surface and disposed relative to the rear wheel members whereby said skating base member may be tilted about the rear wheel axle and engage said auxiliary wheel means with a skating ground surface while disengaging the forward wheel means from the skating ground surface; and said support means including an arm member pivotally attached at one end to said skating base member at a location forwardly of said rearward wheel members, and resilient means disposed between said base member and said arm member for limiting motion of said arm member toward said base member.

2. A skate construction of the type where a skating base member is supported by rotating wheels members on a skating ground surface for permitting tilting of the skating base member relative to the skating ground surface comprising:

an elongated skating base member;

forward and rearward wheel means rotatively supported on said base member, said wheel means being located at the front and the back of said base member for contacting a skating ground surface, said forward wheel means consisting of one forward wheel member located along said lengthwise extending plane, said rearward wheel means including at least two spaced apart rear wheel members on a rear wheel axle, said rear wheel members being respectively located on opposite sides of a vertical lengthwise extending plane extending through said skating base member, said forward wheel member being smaller in diameter than the diameter of the rear wheel members;

auxiliary wheel means disposed rearwardly of said rear wheel members, said auxiliary wheel means consisting of one wheel member located along said lengthwise extending plane and where said one wheel member is smaller in diameter than the diameter of the rear wheel members; and support means attached to said base member for supporting said auxiliary wheel means at a location normally out of contact with a skating ground surface and disposed relative to the rear wheel members whereby said skating base member may be tilted about the rear wheel axle and engage said auxiliary wheel means with a skating ground surface while disengaging the forward wheel means from the skating ground surface, said support means including an arm member and resilient means disposed between said arm member and said skating base member where one end of said arm member is rotatively attached to said skating base member so that upon contact of said auxiliary wheel means with a skating ground surface by virtue of tilting of said base member about the rear wheel members, the degree of tilting is resisted by the compression of the resilient means.

3. The skate construction of claim 2 and further including means for adjusting the degree of compression of said resilient means.

4. The skate construction of claims 1 or 2 and further including a stop member attached to said skating base member so as to be normally located above the skating ground surface and above a lower contact surface of an auxiliary wheel member for providing a limit to the degree of tilting of the skating base member about the rear wheel members.

5. A skate construction of the type where a skating base member is supported by rotating wheel means on a skating ground surface for permitting tilting of the skating base member relative to the skating ground surface comprising;

an elongated skating base member;

forward and rearward wheel means rotatively supported on said base member, said wheel means being located at the front and the back of said base member for contacting a skating ground surface, said rearward wheel means including at least two spaced apart rear wheel members on a rear wheel axle, said rear wheel members being respectively located on opposite sides of a vertical lengthwise extending plane extending through said skating base member, a yoke member for rotatively supporting said rear wheel axle along a transverse axis, said yoke member having an upper portion with a ball socket connection to the base member and a lower portion connected to a stop member where the stop member is normally auxiliary wheel means relative to the auxiliary wheel means, said upper and lower portions located rearwardly of the transverse axis for the rear wheel axle, and means including a resilient shock absorber member for attaching said yoke member to the base member at a location forwardly of the transverse axis for the rear wheel axle;

auxiliary wheel means disposed rearwardly of said rear wheel members; and support means attached to said base member for supporting said auxiliary wheel means at a location normally out of contact with a skating ground surface and disposed rearwardly relative to said stop member and the stop member is located rearwardly relative to the rear wheel members whereby said skating base member may be tilted about the rear wheel axle and engage said auxiliary wheel means with a skating round surface while disengaging the forward wheel means from the skating ground surface and whereby continued tilting will bring said stop member in contact with the skating ground surface.

6. The skate construction of claim 5 wherein said support means includes an arm member, resilient means disposed between said arm member and said skating base member and where one end of said arm member is rotatively attached to said skating base member so that upon contact of said auxiliary wheel means with a skating ground surface by virtue of tilting of said base member about the rear wheel member, the degree of tilting is resisted by the compression of the resilient means.

7. The skating construction of claim 5 wherein there is one front wheel member located at the front of said base member, said one wheel member being located along said lengthwise extending plane.

8. The skating construction of claim 5, wherein there are two front wheel members located at the front of said base member, said front wheel members being respectively located on opposite sides of said lengthwise extending plane.

9. A skate construction of the type where a skating base member is supported by rotating wheel members on a skating ground surface for permitting tilting of the skating base member relative to the skating ground surface comprising:

an elongated skating base platform member having a lengthwise extending vertical plane bisecting said platform member;

a forward wheel member disposed in alignment with said vertical plane and means for rotatively supporting said forward wheel member at the forward end of said platform member;

a pair of rear wheel members disposed on opposite sides of said vertical plane and means for rotatively supporting said rearward wheel members at the rearward end of said platform member;

an auxiliary wheel member disposed in alignment with said vertical plane, said forward and auxiliary wheel member being smaller in diameter than the rear wheel members; and support means for rotatively supporting said auxiliary wheel member normally at a location so as not to contact a skating ground surface when said forward and rearward wheel members are in contact with a skating ground surface and to contact a skating ground surface when said forward wheel member is moved out of contact with a skating ground surface upon tilting of said platform member relative to a skating ground-surface, said support means including an arm member pivotally attached at one end to said skating base member at a location forwardly of said rear wheel members and a resilient means disposed between said base member and said arm member for limiting motion of said arm member toward said base member.

10. The skate construction of claim 9 and further including means for adjusting the degree of compression of said resilient means.

11. The skate construction of claim 9 and further including a stop member attached to said skating base member so as to be normally located above the skating ground surface and above a lower contact surface of said auxiliary wheel member for providing a limit to the degree of tilting of the skating base member about the rear wheel members.

12. A skate construction of the type where a skating base member is supported by rotating wheel members on a skating ground surface for permitting tilting of the skating base member relative to the skating ground surface comprising:

an elongated skating base platform member having a lengthwise extending vertical plane bisecting said platform member:

a forward wheel member disposed in alignment with said vertical plane and means for rotatively supporting said forward wheel member at the forward end of said platform member;

a pair of rear wheel members disposed on opposite sides of said vertical plane and means for rotatively supporting said rearward wheel members on a rear wheel axle at the rearward end of said platform member including a yoke member for rotatively supporting said rear wheel axle along a transverse axis, said yoke member having an upper portion with a ball socket connection to the base platform member and a lower portion connected to a stop member where the stop member is normally disposed above the skating ground surface, said upper and lower portions rearwardly of the transverse axis for the rear wheel axle, and means including a resilient shock absorber member for attaching said yoke member to the base member at a location forwardly of the transverse axis for the rear wheel axle;

an auxiliary wheel member disposed in alignment with said vertical plane; and support means for rotatively supporting said auxiliary wheel member rearwardly of said stop member and normally at a location so as not to contact a skating ground surface when said forward and rearward wheel members are in contact with a skating ground surface and to contact with a skating surface ground while said forward wheel member is moved out of contact with a skating ground surface upon tilting of said platform member relative to a skating ground surface and whereby continued tilting will bring said stop member in contact with said skating ground surface.

13. The skate construction of claim 12 wherein said support means includes an arm member, resilient means disposed between said arm member and said skating base member, where one end of s aid arm member is rotatively attached to said skating base member so that upon contact of said auxiliary wheel means with a skating ground surface by virtue of tilting of said base member about the rear wheel members the degree of tilting is resisted by the compression of the resilient means.

14. A skate construction of the type where a skating base member is supported by rotating wheel members on a skating ground surface for permitting tilting of the skating base member relative to the skating ground surface comprising:

an elongated skating base platform member having a lengthwise extending vertical plane bisecting said platform member;

a pair of forward wheel members disposed on opposite sides of said vertical plane and means for rotatively supporting said forward wheel members at the forward end of said platform member;

a pair of rear wheel members disposed on opposite sides of said vertical plane and means for rotatively supporting said rearward wheel members at the rearward end of said platform member;

an auxiliary wheel member disposed in alignment with said vertical plane and support means for rotatively supporting said auxiliary wheel member normally at a location so as not to contact a skating ground surface when said forward and rearward wheel members are in contact with a skating ground surface and to contact with a skating ground surface while said forward wheel members are moved out of contact with a skating ground surface, when tilting of said platform member occurs relative to a skating ground surface,.said support means including an arm member pivotally attached at one end to said skating base platform member at a location forwardly of said rear wheel members and a resilient means disposed between said base platform member and said arm member for limiting motion of said arm member toward said base platform member.

15. The skate construction of claim 14 and further including means for adjusting the degree of compression of said resilient means.

16. The skate construction of claim 15 and further including a stop member attached to said skating base member so as to be normally located above the skating ground surface and above a lower contact surface of said auxiliary wheel member for providing a limit to the degree of tilting of the skating base member about the rear wheel members.

* * * * *